US007497770B2

(12) United States Patent
Grassmuck et al.

(10) Patent No.: US 7,497,770 B2
(45) Date of Patent: Mar. 3, 2009

(54) AIR LOUVER FOR A REFRIGERATED DISPLAY CASE

(75) Inventors: Michael Donald Grassmuck, Chesterfield, MO (US); Garrick Neal McFarland, Granite City, IL (US); Scott Eugene Miller, Charlotte, NC (US)

(73) Assignee: Hussmann Corporation, Bridgeton, MO (US)

( * ) Notice: Subject to any disclaimer, the term of this patent is extended or adjusted under 35 U.S.C. 154(b) by 308 days.

(21) Appl. No.: 11/059,617

(22) Filed: Feb. 16, 2005

(65) Prior Publication Data

US 2006/0199496 A1 Sep. 7, 2006

(51) Int. Cl.
*F24F 9/00* (2006.01)

(52) U.S. Cl. ..... 454/193; 454/188

(58) Field of Classification Search ..... 454/193, 454/188

See application file for complete search history.

(56) References Cited

U.S. PATENT DOCUMENTS

| | | | | | |
|---|---|---|---|---|---|
| 2,694,357 | A | * | 11/1954 | Lee | 454/76 |
| 2,725,726 | A | | 12/1955 | Swanson | |
| 3,134,243 | A | | 5/1964 | Hagen et al. | |
| 3,203,337 | A | | 8/1965 | Beckwith | |
| 3,233,423 | A | | 2/1966 | Beckwith et al. | |
| 3,256,799 | A | * | 6/1966 | Beckwith et al. | 454/190 |
| 3,287,929 | A | | 11/1966 | Beckwith | |
| 3,291,027 | A | | 12/1966 | Beckwith | |
| 3,771,323 | A | | 11/1973 | Simons et al. | |
| 4,049,300 | A | * | 9/1977 | Schneider | 290/54 |
| 4,648,247 | A | | 3/1987 | Takizawa et al. | |
| 4,807,446 | A | | 2/1989 | Sunaga | |
| 4,840,040 | A | | 6/1989 | Fung | |
| 4,964,281 | A | | 10/1990 | Tanaka | |
| 5,226,295 | A | | 7/1993 | Jaxmar | |
| 6,240,739 | B1 | * | 6/2001 | Hayes | 62/255 |
| 2003/0054750 | A1 | * | 3/2003 | Luik et al. | 454/69 |

FOREIGN PATENT DOCUMENTS

| | | |
|---|---|---|
| EP | 0907059 | 7/1999 |
| GB | 1045363 | 10/1966 |

OTHER PUBLICATIONS

Description of prior art louvers publicly known prior to Feb. 16, 2004, 2 pages.

* cited by examiner

*Primary Examiner*—Steve McAllister
*Assistant Examiner*—Helena Kosanovic
(74) *Attorney, Agent, or Firm*—RatnerPrestia

(57) ABSTRACT

A louver for directing airflow in a refrigerated display case, and a refrigerated display case employing a louver. In some embodiments, the louver includes a plurality of fins positioned to define a plurality of channels therebetween through which airflow can be directed substantially in a first direction. Each fin can be elongated in a second direction substantially orthogonal to the first direction to define a length. Each fin can include an inlet end and an outlet end in a cross-section taken along the length. The louver can further include a curved inlet profile defined by the inlet ends of the plurality of fins.

18 Claims, 4 Drawing Sheets

AIR LOUVER FOR A REFRIGERATED DISPLAY CASE

FIELD OF THE INVENTION

This invention relates to an air louver for a refrigerated display case. More particularly, this invention relates to an air louver and the airflow characteristics of air passing through the air louver.

BACKGROUND OF THE INVENTION

Typically, refrigerated display cases require some type of deflector to deflect air into an air louver, or a plurality of deflectors that both deflect and direct airflow. As a result, two or more pieces are required in a discharge air louver, leading to a more difficult and less accurate and repeatable manufacturing process.

FIGS. 1 and 2 illustrate prior art louvers 11, 51 for refrigerated display cases 10, 50. FIG. 1 shows a refrigerated display case 10 having a louver 11 coupled to an insulated wall 12 and an internal wall 14 of the refrigerated display case 10. The louver 11 is positioned in an air passage 16 of the refrigerated display case 10 through which airflow is directed in the direction of arrow 18.

The louver 11 includes a honeycomb portion 20 and a deflector 22. The honeycomb portion 20 includes a plurality of channels 24 positioned to control the direction of the airflow out of the air passage 16. The deflector 22 is positioned to deflect the airflow as it flows in the direction of arrow 18 toward the honeycomb portion 20. Specifically, the deflector 22 includes a series of linear segments 26 positioned at an angle with respect to one another to impart a specific velocity profile 28 to the airflow passing through the louver 11. As shown in FIG. 1, the combination of the deflector 22 and the honeycomb portion 20 produces an air curtain with a highly variable velocity profile 28. In addition, tolerance stack-ups when manufacturing and/or assembling the deflector 22 and the honeycomb portion 20 may not allow for accurate and repeatable results when manufacturing the refrigerated display case 10.

FIG. 2 shows another prior art refrigerated display case 50 having a louver 51 positioned within an air passage 56 defined by an insulated wall 52 and an internal wall 54. Airflow in the air passage 56 generally flows toward the louver 51 in the direction of arrow 58. The louver 51 is constructed from individual nested turning vanes 60 that define a plurality of channels 61 therebetween. Each turning vane 60 includes a vertical portion 62 and a horizontal portion 64 to control the direction of the airflow. The spacing between adjacent vanes 60 controls the size of the channels 61 therebetween, and causes some channels 61 to receive a greater portion of the airflow than others. Accordingly, the spacing between adjacent vanes 60 imparts a specific velocity profile 68 to the airflow passing through the louver 51. As shown in FIG. 2, the louver 51 produces a stepped velocity profile 68. The individual nested vanes 60 of the louver 51 complicate the production and assembly of the louver 51.

SUMMARY OF THE INVENTION

Some embodiments of the present invention provide a louver for directing airflow in a refrigerated display case. The louver can include a plurality of fins positioned to define a plurality of channels therebetween through which the airflow is directed substantially in a first direction. Each fin can be elongated in a second direction substantially orthogonal to the first direction to define a length. Each fin can include an inlet end and an outlet end in a cross-section taken along the length. The louver can further include a curved inlet profile defined by-the inlet ends of the plurality of fins.

In some embodiments, a refrigerated display case is provided. The refrigerated display case can include an air passage positioned to direct air toward a product display area, and a louver positioned in the air passage to direct airflow toward the product display area. The louver can include a plurality of fins positioned to define a plurality of channels therebetween through which the airflow is directed substantially in a first direction. Each fin of the louver can be elongated in a second direction substantially orthogonal to the first direction to define a length. In addition, each fin can include an inlet end and an outlet end in a cross-section taken along the length. The louver can further include an inlet profile defined by the inlet ends of the plurality of fins, the inlet profile being curved.

Some embodiments of the present invention provide a louver for use in a refrigerated display case. The louver can include a unitary body having a top and a bottom. The unitary body of the louver can include a plurality of substantially parallel elongated fins defining a plurality of channels therebetween. Each of the plurality of channels can include an inlet and an outlet. The inlets of the plurality of channels can decrease in size from the bottom of the unitary body to the top of the unitary body. Each fin can include an inlet end and an outlet end in cross-section. The inlet ends of the plurality of fins can define a curved inlet profile.

Other features and aspects of the invention will become apparent to those skilled in the art upon review of the following detailed description, claims, and drawings.

Figure 1:
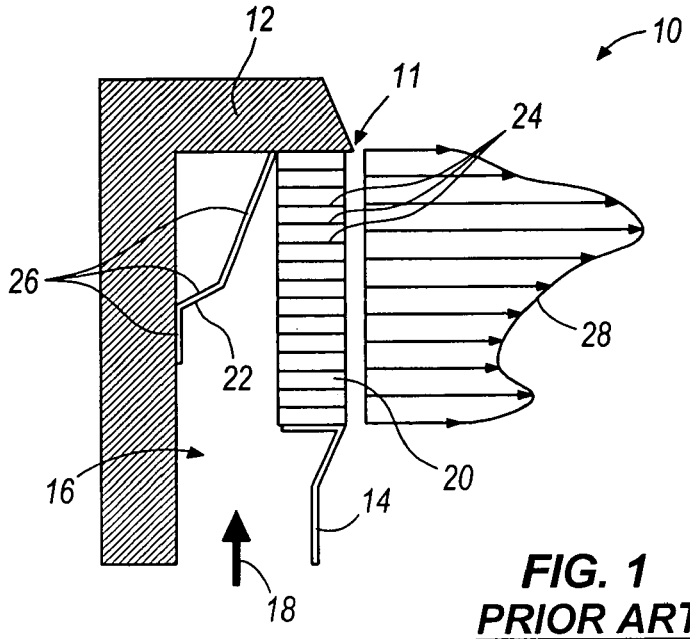
FIG. 1 PRIOR ART
FIG. 1 is a cross-sectional view of a prior art refrigerated display case employing a prior art air louver.
Figure 2:
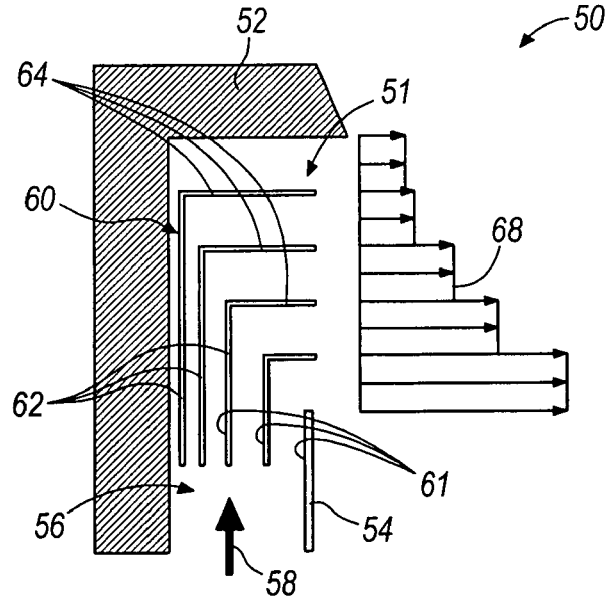
FIG. 2 PRIOR ART
FIG. 2 is a cross-sectional view of another prior art refrigerated display case employing another prior art air louver.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings. Furthermore, terms such as "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

DETAILED DESCRIPTION

Figure 3:
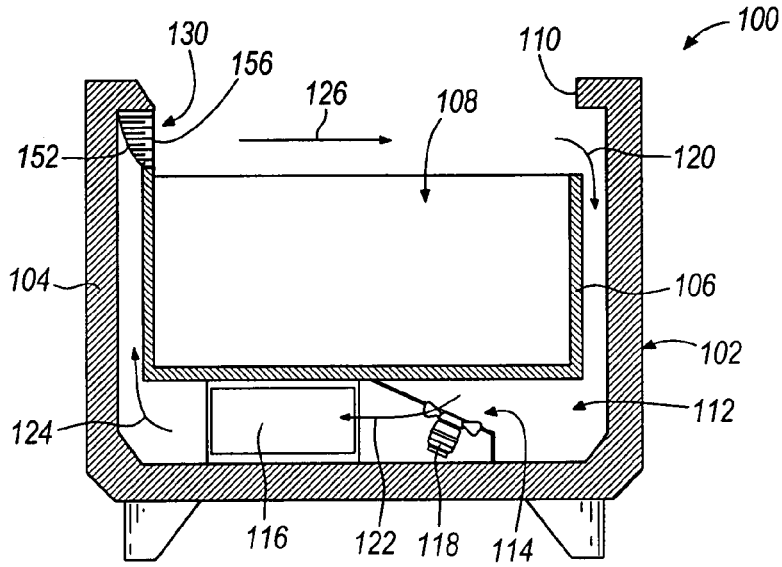
FIG. 3 is cross-sectional view of a refrigerated display case according to one embodiment of the present invention, the refrigerated display case having an air louver.

FIG. 3-6 illustrate a refrigerated display case 100, or a portion thereof, according to one embodiment of the present invention. As illustrated in FIG. 3, the refrigerated display case 100 includes a housing 102 having an outer insulated wall 104 and an inner wall 106. The inner wall 106 defines a product display area (or a low temperature interior) 108 of the refrigerated display case 100. A variety of products can be stored in the product display area 108 to be kept at a desired temperature and displayed. The outer insulated wall 104 is positioned to separate the product display area 108 of the refrigerated display case 100 from the environment. An opening 110 is defined in an upper portion of the outer insulated wall 104 and the inner wall 106 to allow access to the product display area 108. The outer insulated wall 104 and the inner wall 106 can be formed of a variety of materials, including metal, glass, plastic, and combinations thereof.

As shown in FIG. 3, the refrigerated display case 100 includes an air passage 112 defined at least partially by the outer insulated wall 104 and the inner wall 106. As further shown in FIG. 3, a portion of a refrigeration unit 114, including an evaporator assembly 116 and a fan 118, is positioned in the air passage 112 under a lower portion of the inner wall 106 in the refrigerated display case 100. Airflow in the refrigerated display case 100 is represented by arrows 120, 122, 124 and 126. Specifically, the refrigeration unit 114 draws in warmed air (120) from the product display area 108, cools it (122, 124), and discharges cooled air (126) through a louver 130 into the product display area 108 to create an airflow across the product display area 108. The airflow created by the refrigeration unit 114 establishes an air curtain that moves substantially over the opening 110 to allow the product display area 108 to remain at a temperature lower than the environment.

Figure 6:
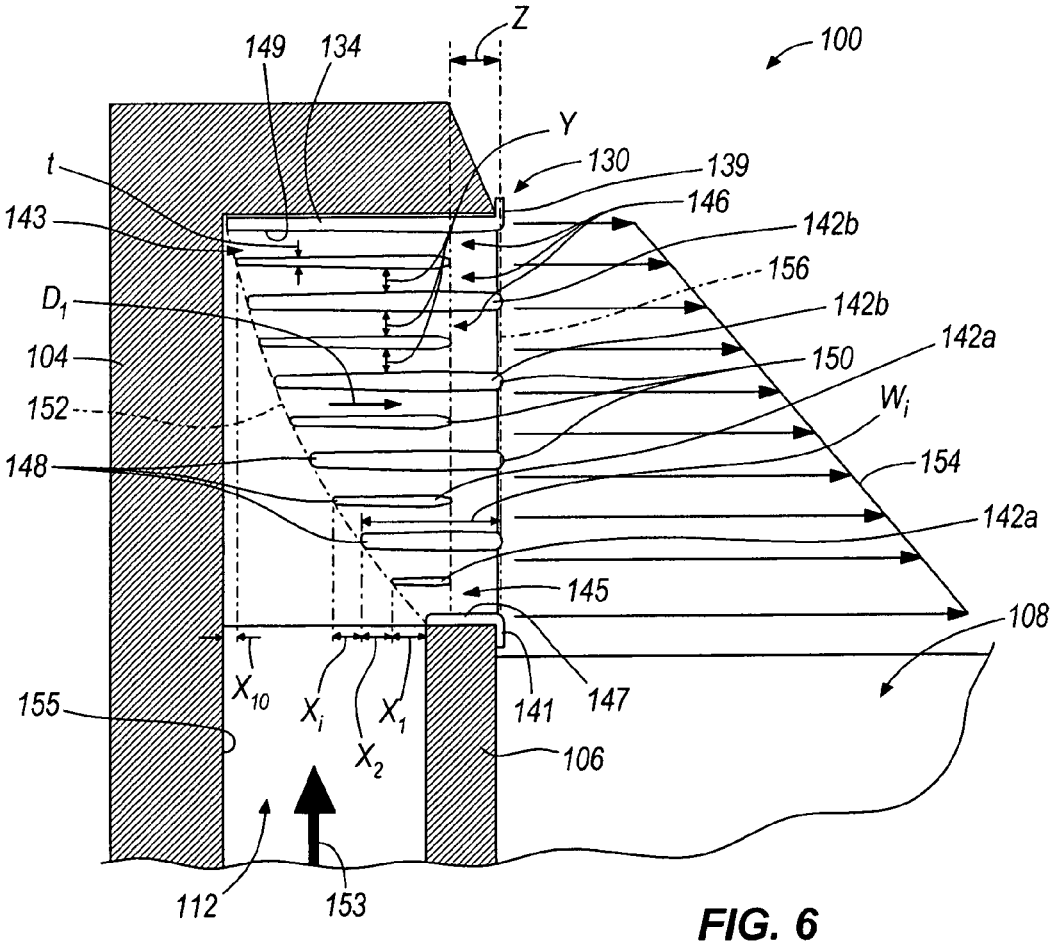
FIG. 6 is an enlarged cross-sectional view of the air louver and refrigerated display case of FIG. 3.
Figure 4:
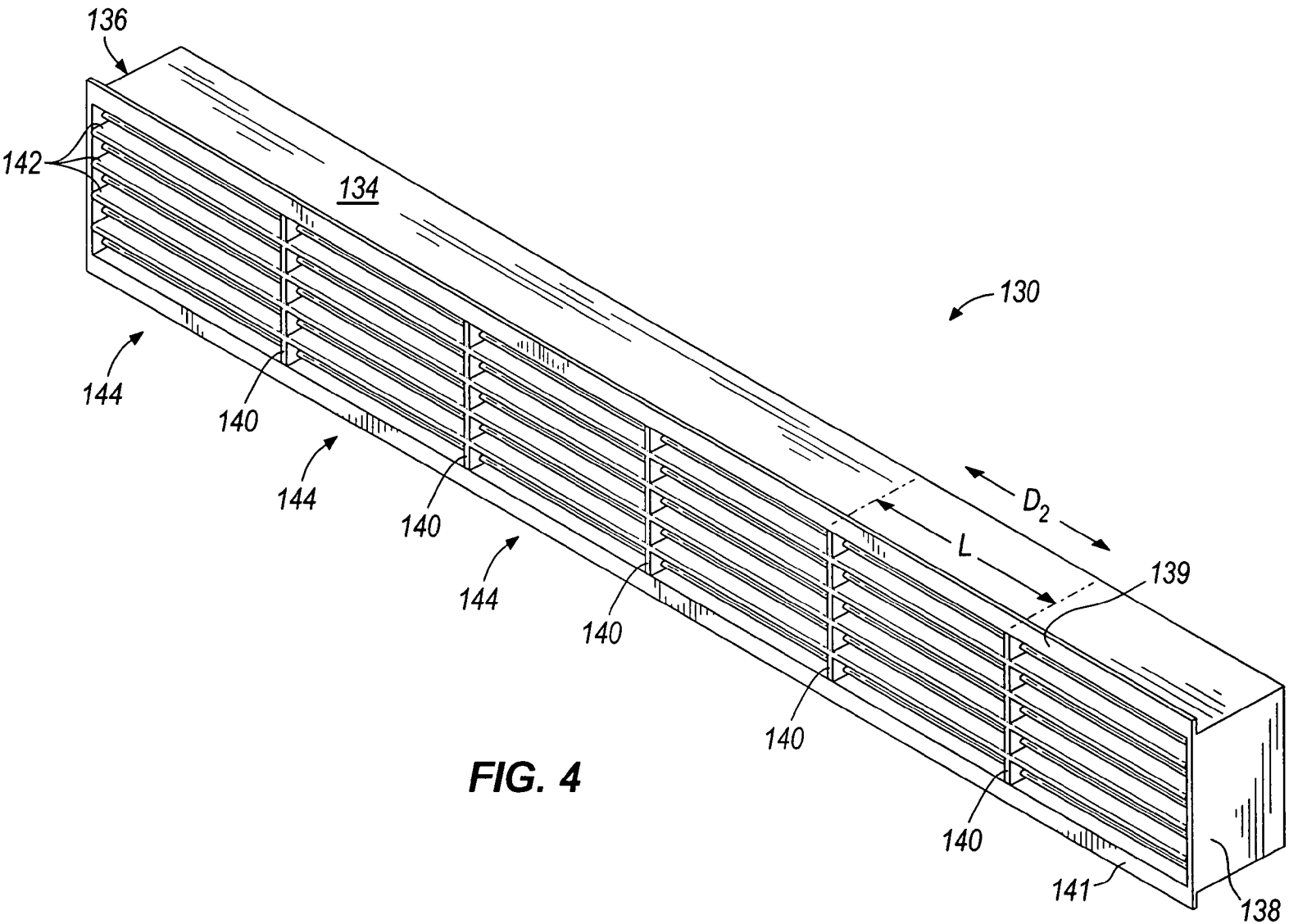
FIG. 4 is a front perspective view of the air louver of FIG. 3.
Figure 5:
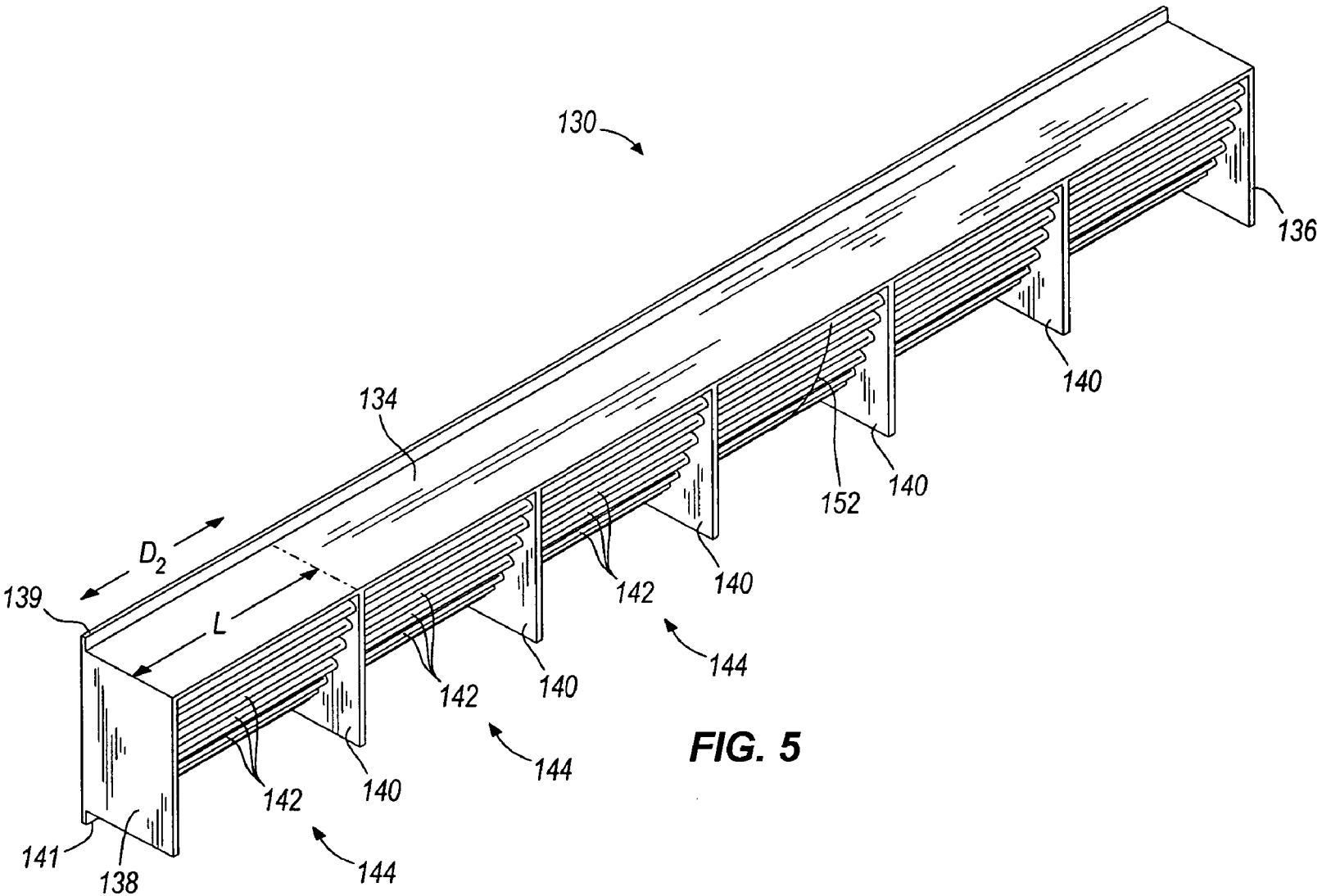
FIG. 5 is a rear perspective view of the air louver of FIG. 4.

As shown in FIGS. 3 and 6, the louver 130 is positioned in the air passage 112 to direct airflow toward the product display area 108. The louver 130 is shown in greater detail in FIGS. 4-6. In the illustrated embodiment, the louver 130 is a unitary body. Particularly, the illustrated louver 130 is a single piece molded out of plastic. However, it should be understood that the louver 130 can be formed of other materials. The louver 130 includes a top horizontal wall 134, a left outer vertical wall 136, a right outer vertical wall 138, and a plurality of inner vertical walls 140. The louver 130 further includes a plurality of substantially parallel and elongated fins 142, which allows the louver 130 to be easily molded by allowing tooling to pull from both a front and a rear side to form the louver 130. As shown in FIGS. 4 and 5, the vertical walls 136, 138, 140 of the louver 130 are generally rectangular in shape. However, any other shape is possible and within the spirit and scope of the present invention. For example, in some embodiments, one or more of the vertical walls 136, 138, 140 of the louver 130 are shaped to match an inlet profile 152 of the fins 142 (which is described in greater detail below).

The louver 130 illustrated in FIGS. 3-6 includes a plurality of repeating units 144, each repeating unit 144 including a left vertical wall (i.e., the left outer vertical wall 136 or an inner vertical wall 140), a right vertical wall (i.e., the right outer vertical wall 138 or an inner vertical wall 140), and a plurality of fins 142 extending substantially horizontally between the left vertical wall and the right vertical wall to define a length L of each fin 142 (FIG. 4). As shown in FIGS. 4 and 5, the illustrated embodiment includes six uniformly-sized repeating units 144, each having a length L, but it should be understood that the repeating units 144 do not all need to be the same size, and that the louver 130 can include as few as one repeating unit 144 (i.e., no inner vertical walls 140) and as many as structurally necessary or possible for the particular refrigerated display case 100. Furthermore, the length L can instead be defined by the length of the entire unitary body of the louver 130, and need not be defined as the length of a repeating unit 144. In addition, the louver 130 need not include a left outer vertical wall 136 or a right outer vertical wall 138, and could instead be "open" on the left and right sides. In some embodiments, as shown in FIGS. 4 and 5, the louver 130 further includes an upwardly-protruding edge 139 and a downwardly-protruding edge 141, which can provide an aesthetic edging and also assist in coupling the louver 130 to the refrigerated display case 100.

FIGS. 3 and 6 illustrate a cross-section of the louver 130 taken along the length L. As shown in FIG. 6, the plurality of fins 142 define a plurality of channels 146 therebetween through which the airflow (e.g., the cooled air 124, as shown in FIG. 3) in the refrigerated display case can be directed substantially in a first direction Do. Each channel 146 includes an inlet 143 and an outlet 145. As shown in FIGS. 4 and 5, each fin 142 extends substantially in a second direction $D_2$ (i.e., to define the length L), which is substantially orthogonal to the first direction $D_1$. As further shown in FIG. 6, each fin 142 has a thickness t, which increases in the first direction $D_1$. Such an airfoil shape suppresses turbulent recirculation.

As further shown in FIG. 6, which shows each fin 142 in cross-section, each fin 142 includes an inlet end 148 and an outlet end 150. The plurality of inlet ends 148 define the inlet profile 152 of the louver 130. The inlet profile 152 illustrated in FIGS. 3 and 5 is curved. Particularly, the inlet profile 152 includes a substantially parabolic shape. The inlet profile 152 controls the portion of the airflow that enters each channel 146, and thus, imparts a specific velocity profile 154 to the airflow passing through the louver 130. For example, the parabolic inlet profile 152 provides a tapered velocity profile 154. That is, due to the parabolic shape of the inlet profile 152, a greater portion of the airflow entering the louver 130 enters lower channels 146, and a lesser portion of the airflow entering the louver 130 enters upper channels 146, thereby creating a velocity profile 154 in which the airflow out of the lower channels 146 is faster than the airflow out of the upper channels 146.

As shown in FIG. 6, a lowermost channel 147 has the largest inlet 143 of the plurality of inlets 143, and the airflow out of the lowermost channel 147 is the fastest. Furthermore, an uppermost channel 149 has the smallest inlet 143 of the plurality of inlets 143, and the airflow out of the uppermost channel 149 is the slowest. That is, the airflow out of the louver 130 adjacent the product display area 108 is faster than the airflow out of the louver 130 adjacent the environment. Other curved profiles are possible to produce other desired velocity profiles in which the velocity of the airflow is greater adjacent the product display area 108 than the environment, and are within the spirit and scope of the present invention.

The shape of the inlet profile 152 is produced by offsetting the inlet ends 148 of adjacent fins 142 from one another by a distance $X_i$ in the first direction. As shown in FIG. 6, the offset distance $X_i$ between adjacent fins 142 decreases from a bottom of the louver 130 to a top of the louver 130. That is, when viewing the louver 130 in cross-section (as shown in FIG. 6), the horizontal distance between the inlet ends 148 decreases from a lowermost fin 142 to an uppermost fin 142. As shown in FIG. 6, the lowermost offset distance $X_1$ (i.e., the offset distance in the first direction $D_1$ between the first (lowest) fin 142 and the second fin 142) at the bottom of the louver 130 is the largest offset distance, and $X_{10}$ (i.e., the offset distance between the tenth (highest) fin 142 and the top horizontal wall 134) is the smallest offset distance. By way of example only, the louver 130 illustrated in FIG. 6 has ten fins 142 and a top horizontal wall 134 which at least partially functions as a fin 142, but it should be understood that the louver 130 can have as few as one fin 142 and as many as structurally necessary or possible.

As shown in FIG. 6, the airflow in the air passage 112 is generally directed toward the louver 130 in the direction represented by arrow 153. The louver 130 is positioned within the air passage 112 such that the first direction $D_1$ in which the airflow is directed through the louver 130 is substantially orthogonal to the direction 153 of airflow in the air passage 112. Because of the position of the louver 130 in the air passage 112 and the shape of the inlet profile 152, the distance between the inlet end 148 of the fins 142 and an inner surface 155 of the outer insulated wall 104 decreases from the bottom of the louver 130 to the top of the louver 130. Accordingly, the portion of the airflow entering each channel 146 decreases from the bottom of the louver 130 to the top of the louver 130.

The vertical spacing between adjacent fins 142 in the louver 130 remains substantially constant from the bottom of the louver 130 to the top of the louver 130. As shown in FIG. 6, each fin 142 is separated by a distance Y from an adjacent fin 142. Thus, the largest portion of airflow enters the lowermost channel 146 in the louver 130, and the smallest portion of airflow enters the uppermost channel 146 in the louver 130, and the portion of the airflow entering each channel 146 decreases from the bottom of the louver 130 to the top of the louver 130. In some embodiments, the vertical spacing between adjacent fins 142 is not substantially constant, but rather varies from the bottom of the louver 130 to the top of the louver 130, and still imparts a tapered velocity profile 154 to the airflow passing through the louver 130.

As shown in FIG. 6, each fin 142 extends in the first direction $D_i$ to define a width $W_i$. In the embodiment shown in FIGS. 4-6, the length L of each fin 142 is greater than the width $W_i$ of each fin 142. As shown in FIG. 6, the width $W_i$ of each fin 142 varies from the bottom of the louver 130 to the top of the louver 130, such that the fins 142 generally increase in width $W_i$ from the bottom to the top of the louver 130.

As shown in FIG. 6, the outlet end 150 of every fin 142 is offset a distance Z from the outlet end 150 of an adjacent fin 142, and the offset distance Z is substantially constant from the bottom of the louver 130 to the top of the louver 130. Accordingly, as shown in FIG. 6, the plurality of fins 142 includes a plurality of shorter fins 142*a*, and a plurality of longer fins 142*b*. The longer fins 142*b* increase in width $W_i$ from the bottom of the louver 130 to the top of the louver 130. Similarly, the shorter fins 142*a* increase in width $W_i$ from the bottom of the louver 130 to the top of the louver 130.

The louver 130 includes a substantially linear outlet profile 156. The outlet profile 156 is defined by the outlet ends 150 of the longer fins 142*b*. In some embodiments, as shown in FIG. 6, each channel 146 is defined between a shorter fin 142*a* and a longer fin 142*b*. In other embodiments, each channel 146 is defined between two longer fins 142*b*, such that each channel 146 is at least partially bifurcated by a shorter fin 142*a*.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

The invention claimed is:

1. A louver for directing airflow in a refrigerated display case, the louver comprising:

a plurality of fins positioned to define a plurality of channels therebetween through which the airflow is directed substantially in a first direction, each fin being elongated in a second direction substantially orthogonal to the first direction to define a length, each fin having an inlet end and an outlet end in a cross-section taken along the length; and an inlet profile defined by the inlet ends of the plurality of fins, the inlet profile having a width perpendicular to the second direction and being non-linear across its width and a linear outlet profile defined by the outlet ends of every other fin in the plurality of fins, with the outlet ends of the intermediate ones of the plurality of fins being recessed in the first direction relative to the linear outlet profile.

2. The louver of claim 1, wherein each of the plurality of fins increases in thickness from the inlet end to the outlet end.

3. The louver of claim 1, wherein each inlet end of the plurality of fins is offset a distance in the first direction from an adjacent inlet end, and wherein the offset distance between adjacent inlet ends decreases from a lowermost fin to an uppermost fin.

4. The louver of claim 1, wherein the inlet profile includes a substantially parabolic shape.

5. The louver of claim 1, wherein each fin includes a width extending in the first direction, the length of each fin being greater than the width of each respective fin.

6. The louver of claim 1, wherein the plurality of fins are substantially horizontal and a spaced a vertical distance apart, and wherein the vertical distance is substantially constant.

7. The louver of claim 6, wherein the inlet ends of the plurality of fins are spaced a horizontal distance apart, and wherein the horizontal distance decreases from a bottom of the louver to a top of the louver.

8. The louver of claim 1, wherein each of the plurality of channels includes an inlet and an outlet, and wherein a lowermost channel has the largest inlet and is adapted to receive the greatest portion of the airflow and an uppermost channel has the smallest inlet and is adapted to receive the least portion of the airflow to provide a tapered velocity profile to the airflow out of the louver, such that the portion of the airflow out of the uppermost channel is slower than the portion of the airflow out of the lowermost channel.

9. A refrigerated display case comprising:

an air passage positioned to direct air toward a product display area; and a louver positioned in the air passage to direct airflow toward the product display area, the louver including a plurality of fins positioned to define a plurality of channels therebetween through which the airflow is directed substantially in a first direction, each fin being elongated in a second direction substantially orthogonal to the first direction to define a length, each fin having an inlet end and an outlet end in a cross-section taken along the length, and an inlet profile defined by the inlet ends of the plurality of fins, the inlet profile having a width perpendicular to the second direction and being non- linear across its width a linear outlet profile defined by the outlet ends of every other fin in the plurality of fins, with the outlet ends of the intermediate ones of the plurality of fins being recessed relative to the linear outlet profile.

10. The refrigerated display case of claim 9, wherein each of the plurality of fins increases in thickness from the inlet end to the outlet end.

11. The refrigerated display case of claim 9, wherein the inlet profile includes a substantially parabolic shape.

12. The refrigerated display case of claim 9, wherein the inlet ends of the plurality of fins are offset a distance in the first direction from one another, and wherein the offset distance between adjacent inlet ends increases from a bottom of the louver to a top of the louver.

13. The refrigerated display case of claim 12, wherein the inlet ends of the plurality of fins are spaced a vertical distance apart, and wherein the vertical distance between adjacent inlet ends is substantially constant from a bottom of the louver to a top of the louver.

14. The refrigerated display case of claim 9, wherein each fin extends in the first direction to define a width, the length of each fin being greater than the width of each respective fin.

15. The refrigerated display case of claim 9, wherein the inlet ends of the plurality of fins are spaced a horizontal distance apart, and wherein the horizontal distance decreases from a lowermost fin to an uppermost fin.

16. The refrigerated display case of claim 9, wherein each of the plurality of channels includes an inlet and an outlet, wherein the louver is positioned such that the airflow out of a lowermost channel is adjacent the product display area, and wherein the lowermost channel has the largest inlet and is adapted to receive the greatest portion of the airflow and an uppermost channel has the smallest inlet and is adapted to receive the least portion of the airflow to provide a tapered velocity profile to the airflow out of the louver, such that the portion of the airflow adjacent the product display area is faster than the remaining portions of the airflow out of the louver.

17. A louver for use in a refrigerated display case, the louver comprising:

a unitary body having a top and a bottom including a plurality of substantially parallel elongated fins defining a plurality of channels therebetween, each of the plurality of channels having an inlet and an outlet, the inlets of the plurality of channels decreasing in size from the bottom of the unitary body to the top of the unitary body, each fin having an inlet end and an outlet end in cross-section, the inlet ends of the plurality of fins defining an inlet profile having a width and being non-linear across its width wherein the unitary body further comprises a linear outlet profile defined by every other outlet end of the plurality of fins, with the outlet ends of the intermediate ones of the plurality of fins being recessed in the first direction relative to the linear outlet profile.

18. The refrigerated display case of claim 9, wherein the outlet ends of the plurality of fins define an outlet passage directly adjacent to the product display area.

* * * * *